US005757109A

United States Patent [19]

Parvin

[11] Patent Number: 5,757,109

[45] Date of Patent: May 26, 1998

[54] TELESCOPIC DRAWER SLIDE WITH SOFT SEQUENCING LATCH

[75] Inventor: Jackie D. Parvin, Pomona, Calif.

[73] Assignee: Accuride International, Inc., Santa Fe Springs, Calif.

[21] Appl. No.: 796,055

[22] Filed: Feb. 7, 1997

[51] Int. Cl.[6] ..... A47B 88/00

[52] U.S. Cl. ..... 312/334.11; 312/334.46

[58] Field of Search ..... 312/333, 334.1, 312/334.7, 334.8, 334.11, 334.17, 334.46, 334.44; 384/18, 21, 22

[56] References Cited

U.S. PATENT DOCUMENTS

| | | | |
|---|---|---|---|
| 1,582,556 | 4/1926 | Stuck . | |
| 1,963,220 | 6/1934 | Anderson | 44/77 |
| 2,606,090 | 8/1952 | Straubel | 312/339 |
| 2,655,422 | 10/1953 | Gussack | 312/333 |
| 3,488,097 | 1/1970 | Fall | 308/3.8 |
| 3,912,341 | 10/1975 | Stein | 308/3.8 |
| 4,272,139 | 6/1981 | Fler | 312/334 |
| 4,351,575 | 9/1982 | Rock et al. | 308/3.8 |
| 4,370,007 | 1/1983 | Fler | 312/334 |
| 4,469,384 | 9/1984 | Fler et al. | 312/333 |
| 4,537,450 | 8/1985 | Baxter | 308/3.8 |
| 4,549,773 | 10/1985 | Papp et al. | 308/3.8 |
| 4,560,212 | 12/1985 | Papp et al. | 308/3.8 |
| 4,563,044 | 1/1986 | Rees | 308/3.8 |
| 4,610,487 | 9/1986 | Delmege et al. | 384/18 |
| 4,662,761 | 5/1987 | Hoffman | 384/18 |
| 4,696,582 | 9/1987 | Kasten | 384/18 |
| 4,749,242 | 6/1988 | Rechberg | 312/333 |
| 4,988,214 | 1/1991 | Clement | 384/18 |
| 4,998,828 | 3/1991 | Hobbs | 384/18 |
| 5,033,805 | 7/1991 | Hobbs . | |
| 5,181,782 | 1/1993 | Wojcik | 384/21 |
| 5,417,490 | 5/1995 | Hobbs et al. . | |
| 5,551,775 | 9/1996 | Parvin | 312/334.11 |

FOREIGN PATENT DOCUMENTS

| | | |
|---|---|---|
| 2721231 | 11/1978 | Germany . |
| 2028109 | 3/1980 | United Kingdom . |

*Primary Examiner*—Peter R. Brown
*Assistant Examiner*—Gerald A. Anderson
*Attorney, Agent, or Firm*—Christie, Parker, & Hale, LLP

[57] ABSTRACT

A sequencing latch adapted for use with drawer slides. The sequencing latch comprises a latch arm carried by a slide member, a spring arm extending from the latch arm in compressive contact with the slide member biasing the latch arm into engagement with a locking element on a second slide member and an actuator on a third slide member for disengaging the latch arm. The actuator disengages the latch arm by applying a force to the latch arm with a component oppositely directed and of sufficient magnitude to overcome the compressive spring force. Interaction of the locking element with the latching arm and the interaction of the actuator with the latching arm may both serve as frictional interfaces during slide operation.

20 Claims, 8 Drawing Sheets

TELESCOPIC DRAWER SLIDE WITH SOFT SEQUENCING LATCH

FIELD OF THE INVENTION

The present invention relates to sequencing latches for ball bearing slides. The invention specifically relates to telescopic slides having slide members where the members are so sequenced so that under certain conditions there is preferential movement of two slide members relative to a third slide member.

BACKGROUND OF THE INVENTION

Telescopic slides for file drawers and the like are often desirable for use in cabinets and other rack-mounted applications. Such slides permit easy access to the interior of the drawer. The slides maintain the drawer in a horizontal position regardless of how far the drawer is withdrawn from the cabinet. A typical drawer slide has three slide members slidably secured to each other by sets of ball bearings held by retainers riding in raceways formed on the slide members.

Three element telescopic slides normally include an outer slide member, an intermediate slide member, and an inner slide member. For purposes of exposition, the outer slide member is connected to the cabinet or enclosure, although it is recognized that the inner slide member may instead be so connected. When the outer slide member is connected to the cabinet or enclosure, the slide member affixed to the drawer is the inner slide member. The intermediate slide member is slidably connected to both the outer and inner slide members. In such a configuration, when the drawer is in a fully open position, the slide members will be positioned such that the intermediate slide member is extended relative to the outer slide member and the inner slide member is extended relative to the intermediate slide member.

In such basic slide mechanisms, the order in which the intermediate slide member extends relative to the outer slide member and the inner slide member extends relative to the intermediate slide member is not necessarily predetermined. Considerations of strength and smoothness of operation may render a given order or sequence preferable in a given slide configuration. Activation of external mechanisms such as cabinet interlocks may require a specific sequence of operation. In addition, a typical drawer is supported by two slide assemblies, one at each side. It is desirable that the slide members of both slide assemblies extend in the same order. If the two slide assemblies have not extended in the same order the load carrying capability of the slides may be reduced.

Slide assemblies providing for sequencing action are disclosed in U.S. Pat. No. 4,537,450 by Alan R. Baxter and U.S. Pat. No. 5,181,782 by Thadeus H. Wojcik. The sequencing mechanisms in the disclosed slides rely on the interaction of at least one resilient latching member. A weakness of such a design lies in the loss of elasticity of the resilient latch member. Another difficulty with the use of resilient latching components is that by their nature they require strict attention to their dimensions. If the resilient latch member is of insufficient size, no sequencing will occur. If the resilient latching member is of too great a size, the resilient latch member will bind with the latching mechanism thereby preventing extension of the slide. Thus, care must be taken in the manufacturing process not to exceed certain very specific and tight tolerances. Furthermore, resilient latching members formed of materials such as polyurethane may interact with grease, oil, or other petroleum based lubricants. Depending on the materials utilized, resilient latch members may have a tendency to absorb such lubricants, the absorption causing the resilient latch member to swell in size. This increase in size may cause greater than normal force to be required to release sequenced drawer slides.

A slide that uses a pivoting latch member is shown U.S. Pat. No. 5,551,775 by the present inventor, the disclosure of which is hereby incorporated by reference. That slide uses a single pivoting latch member which does not rely on resilient members for its action. However, the slide may generate excessive noise when its pivoting latch member is forced to pivot due to contact with the inner slide member as well as when the pivoting latch member reaches the limits of its pivot range. Moreover, this pivoting latching member utilizes the force of gravity to cause the latching member to return to the engageable position. Thus, the disclosed latch would not perform its function in drawer slide mounting configurations where the drawer slides are not mounted vertically such as in an undermount drawer slide, where the slide is installed horizontally beneath a drawer.

Additionally, drawer slide ball bearing migration can cause this latch to become inoperative. Ball bearing migration occurs when slight variations in the surface of the raceways in which the ball bearings ride causes either a temporary loss of contact between the ball bearings and the raceway or a slight obstruction in ball bearing movement along the raceway. During repeated cyclic activity these variations can cause the ball bearing retainer to change position relative to the slidably connected drawer slides. When the ball bearing retainer is part of or interacts with the stopping mechanism which prevents connected slides from deploying from one another this relative change in position can result in connected slides being unable to reach their maximum designed relative extension. In such an occurrence the latch member of U.S. Pat. No. 5,551,775 prevents the engaged slide member from further slidable extension, absent a force sufficient to deform or shear off a portion of the latch member.

Although recycling stops may be used to reposition or recycle the ball bearing retainers to their original designed positions, recycling stops depend on the drawer being fully opened or closed with some force to effect the repositioning of the retainers. In normal use a drawer may not be regularly fully extended when opened, or extended with insufficient force to recycle the ball bearing retainer position. Thus, the use of recycling stops does not provide a complete solution to the detrimental effect of ball bearing migration on latch operation.

SUMMARY OF THE INVENTION

The present invention provides a sequencing mechanism for telescopic slides having outer, intermediate, and inner slide members. The sequencing mechanism comprises a latch arm carried by the intermediate slide member, a locking element on the inner slide member, and an actuating element on the outer slide member. The latch arm utilizes compressive forces on a spring arm integrally formed with the latch arm and in contact with the intermediate slide member to maintain or bias the latch arm in a normally biased or engageable position with respect to the locking element on the inner slide member. The actuating element, a ramp projecting from the outer slide member, interacts with a projection of the latch arm to overcome the biasing force generated by the compression of the spring arm, thereby biasing the latch arm out of the engageable position and allowing the inner slide member to travel freely.

By providing a rotatable latch arm to provide slide member sequencing the present invention avoids the necessity of very specific and tight tolerances of resilient latching members. The concomitant problem of absorption of petroleum based lubricants, with the resulting change in size of the latching member, is also avoided. The use of a spring arm to maintain the latch arm in the biased position reduces noise associated with latch operation. The spring arm also allows the slide assembly to be mounted in any orientation, as the latch operation is not gravity dependent. Additionally, the present invention allows for slide operation even if ball bearing migration occurs, and does so without requiring permanent latch arm deformation.

BRIEF DESCRIPTION OF THE DRAWINGS

Details of the invention are described below and will be more fully appreciated with reference to the accompanying drawings.

DETAILED DESCRIPTION

Figure 1:
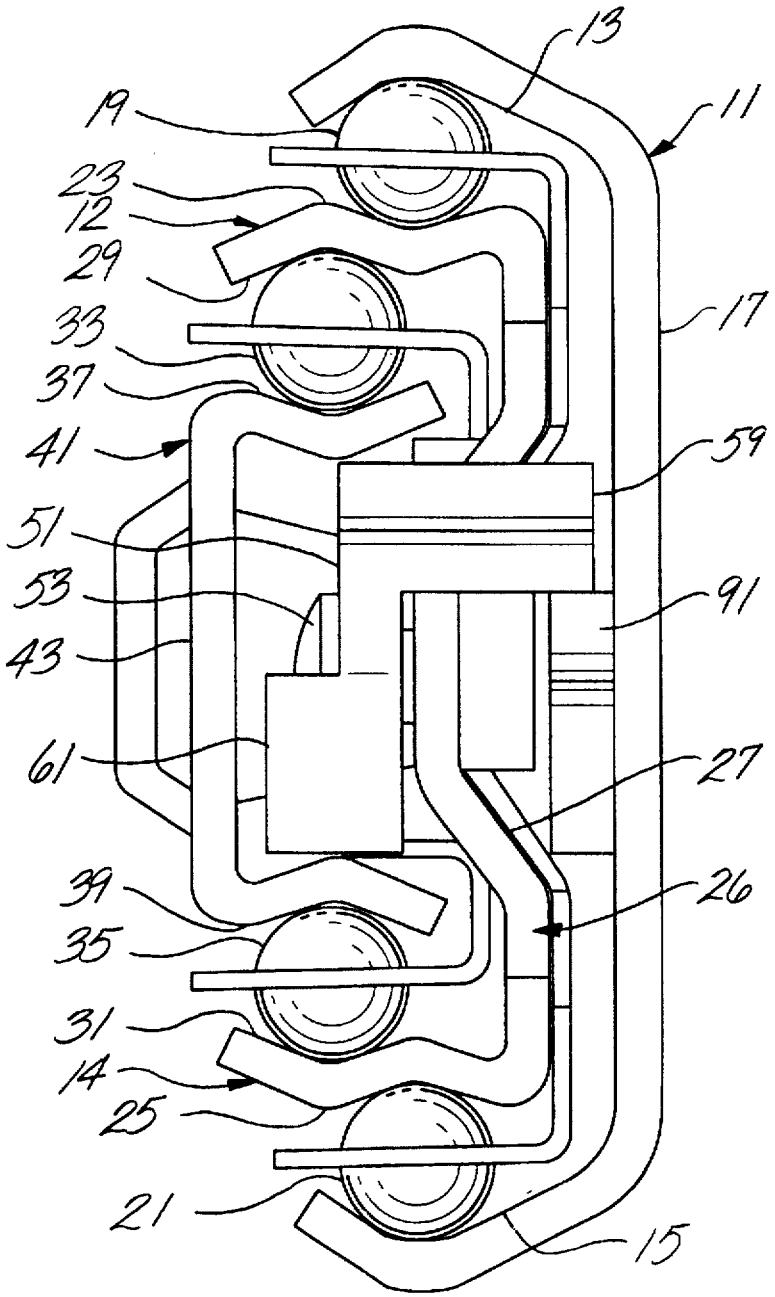
FIG. 1 is a sectional end view of an embodiment of the slide of the present invention in a non-extended position.

As viewed in FIG. 1, an outer slide member 11 is of a generally C-shaped cross section. The outer slide member 11 is referred to by a number of terms, such as a base, stationary, or cabinet slide member. The outer slide member 11 has a pair of ball bearing raceways, an upper raceway 13 facing down and a lower raceway 15 facing up. These raceways can be said to be a pair of raceways facing vertically inward, the vertical direction being used for reference only as the slide is able to be placed in any number of orientations. Upper and lower raceways 13, 15 are formed in the top and bottom portions of the outer slide member 11 and are supported by a substantially flat vertical web 17 forming the outward side of the slide member which is secured to a cabinet or rack. Web 17 need not be substantially flat and a number of structural configurations may be used to connect raceways 13, 15.

Intermediate slide member 26 comprises a generally vertical web portion 27 with generally horizontal arms 12, 14 extending perpendicularly from upper and lower portions, respectively, of web 27. The top face of arm 12 defines an outwardly facing raceway 23 and the bottom face of arm 12 defines an inwardly facing raceway 29. The top face of arm 14 defines an outwardly facing raceway 25 and the bottom face of arm 14 defines an inwardly facing raceway 31. Web 27 of the intermediate slide member 26 is not substantially flat so as to provide space in which to mount items on or project items from the interior of web 17 of the outer slide member 11.

A first plurality of upper and lower bearings 19, 21 are located in and engage upper and lower raceways 13, 15 respectively, of the outer slide member 11. These upper and lower bearings 19, 21 similarly engage the outwardly facing raceways 23, 25 of the intermediate slide member 26. Connecting the outer slide member 11 to the intermediate slide member 26 by means of the upper and lower ball bearings 19, 21 causes the slide members to be slidably connected. Mechanisms for slidably connecting drawer slides are well-known, and many variations of the above-described mechanism will be apparent to those skilled in the art.

A plurality of upper and lower bearings 33, 35 are located in and engage the vertically inward facing raceways 29, 31 of the intermediate slide member 26. These bearings 33, 35 contact upper and lower vertically outward facing raceways 37, 39 of a generally C-shaped inner slide member 41. Upper and lower raceways 37, 39 of the inner slide member 41 are supported by a substantially flat vertical web 43 forming the inward or interior side of the slide assembly.

Figure 2:
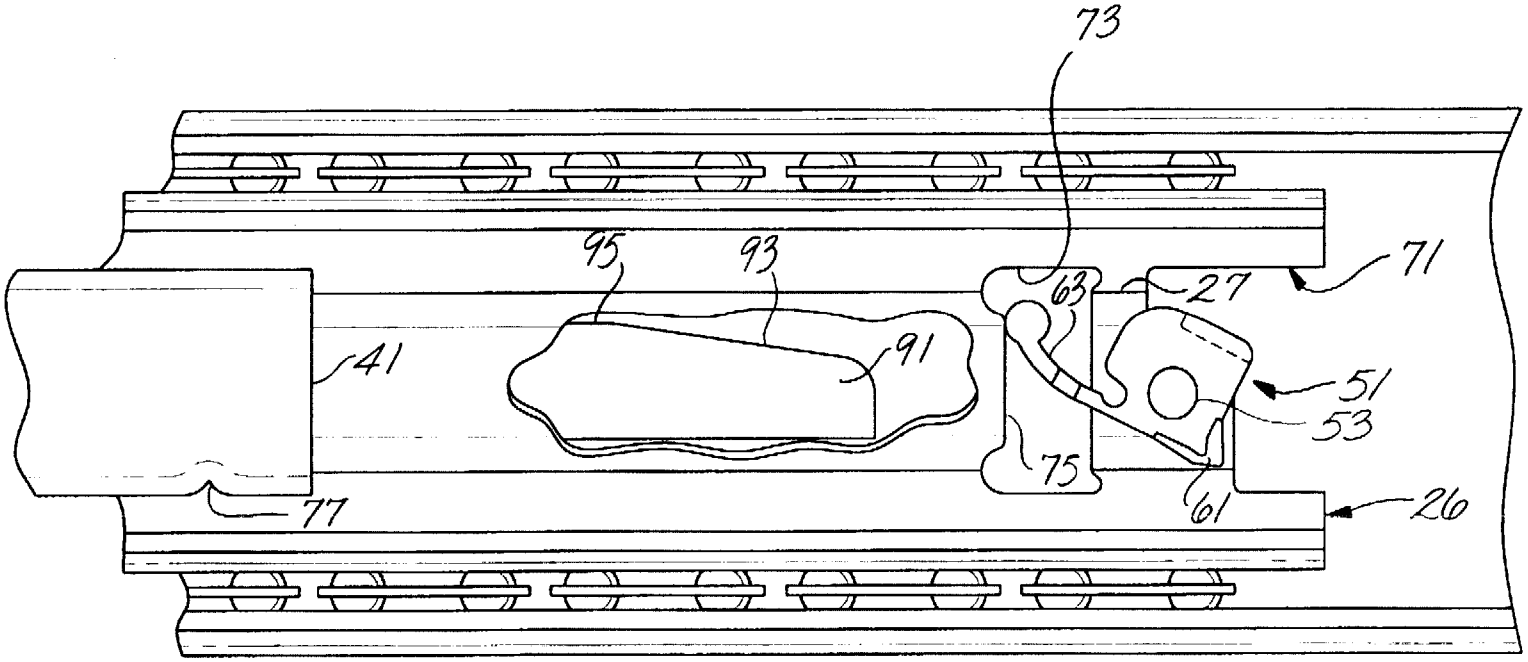
FIG. 2 is an in-board side view of the slide of FIG. 1 in a partially extended position with a portion of the web of the intermediate slide member cut away.

Referring to FIG. 2, a latch arm 51 is carried by the intermediate slide member 26. Latch arm 51 is pivotally mounted to the intermediate slide member 26 by means of a shoulder rivet 53 extending into the central portion of the intermediate slide member's web 27. A number of methods may be used to pivotally mount latch arm 51 to the intermediate slide member 26, such as using a cylindrical protrusion with resilient retention barbs from the latch arm or an extruded post on the intermediate slide with a semitubular rivet in place of the shoulder rivet 53.

Figure 3:
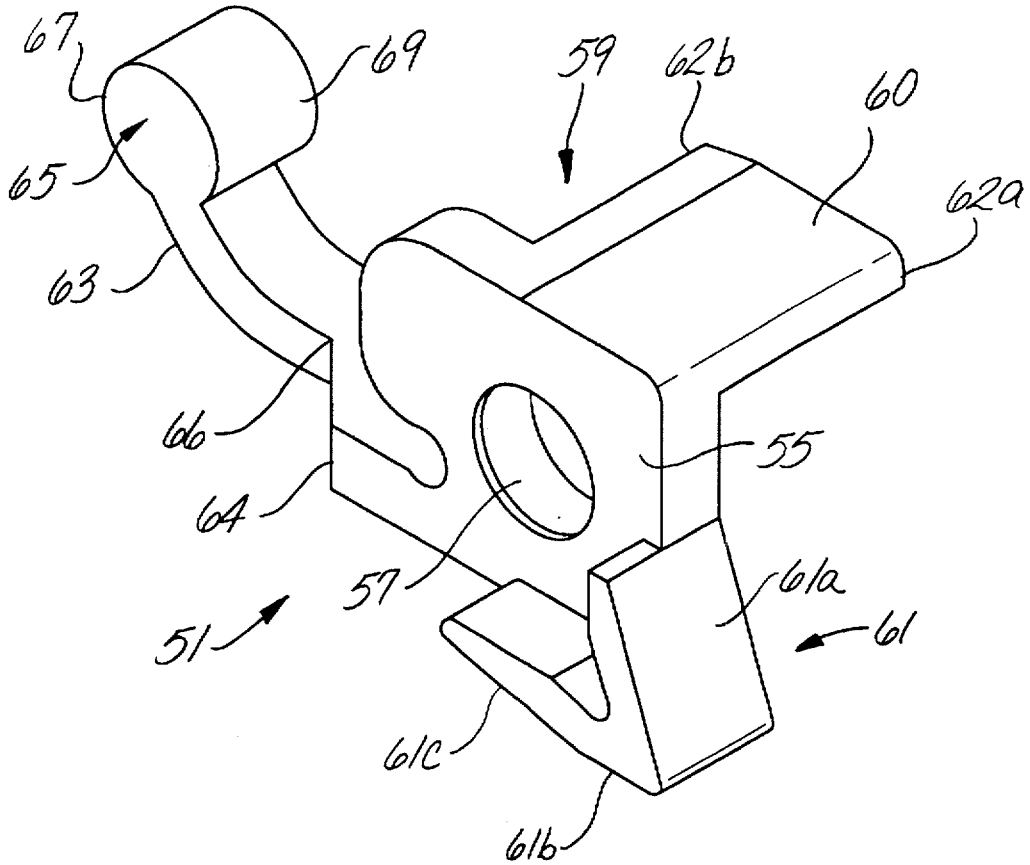
FIG. 3 is a perspective view of an embodiment of the latch arm of the present invention.

As shown in FIG. 3, latch arm 51 is a unitarily formed structure with a substantially flat vertical body 55. A pivot hole 57 extends perpendicularly through vertical body 55 for receiving the rivet 53 to pivotally mount latch arm 51 to the intermediate slide member 26. A spring arm 63, which may be called a spring portion, extends from what will be termed the lower and forward edge of body 55, lower and forward being used for reference purposes only. Spring arm 63 extends from vertical body 55 in the forward direction in an upward arc. Spring arm 63 does not form a linear arc, however. Approximately at the midpoint of spring arm 63 is a first bend 64 and second bend 66 that translates the arc of spring arm 63 to a plane parallel to the plane of vertical body 55. The coplanar translation of the arc is for reasons that are discussed below.

Figure 4:
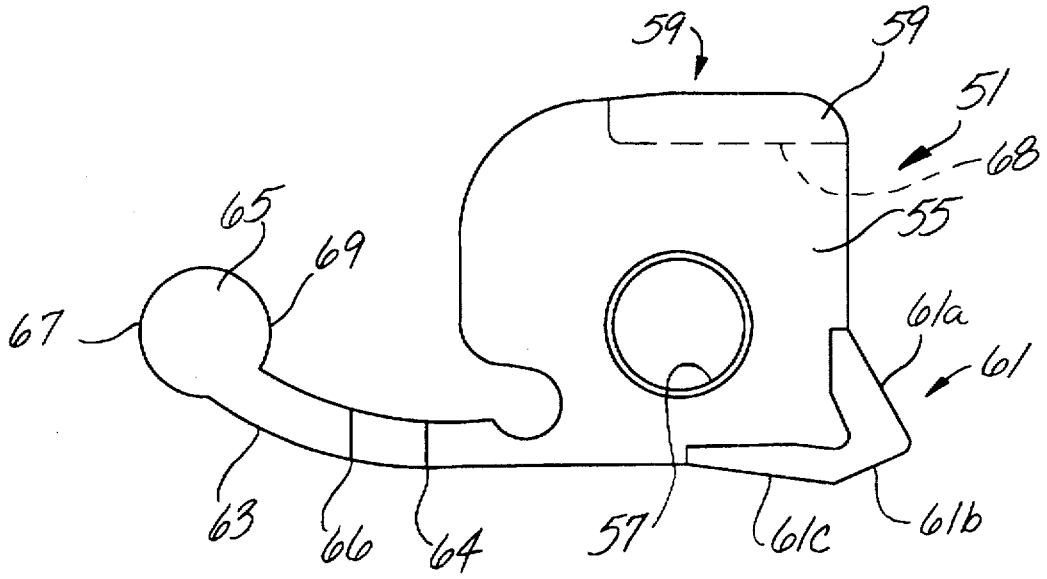
FIG. 4 is a side view of the latch arm of FIG. 3.

At the end of spring arm 63 is an enlarged cylindrical section 65 having rounded front and back surfaces 67, 69, the enlarged section 65 having an axial dimension greater than the thickness of vertical body 55. The front surface 67 forms the surface of the spring arm farthest from the pivot hole or axis. A cantilevered projection 59 is integrally formed with vertical body 55 and extends perpendicular, or transverse, to the upper and rearward portion of vertical body 55. Projection 59 comprises an upper surface 60 oriented substantially horizontally, side surfaces **62*a,b* extending vertically from the upper surface 60, and a bottom surface 68 (shown in phantom in FIG. 4) extending between side surfaces 62*a,b*. Extending from the lower rear portion of vertical body 55 is a generally V-shaped projection 61. V-shaped projection 61 is positioned such that the point of the V extends in the rearward direction. V-shaped projection 61 has three faces 61*a–c*, one of which is a stop face 61*a*. The stop face 61*a* forms an obtuse angle with the rear edge of vertical body 55. An intermediate face 61*b* is connected to the stop face 61*a* at an acute angle forming the apex of the V-shaped projection 61. A transition face 61*c* connects the intermediate face 61*b* with the lower edge of the vertical body 55**, with both connections forming obtuse angles.

Referring again to FIG. 2, an aperture 73 is formed in the web 27 of the intermediate slide member 26, creating an edge surface 75 facing the latch arm 51. This edge surface 75 need not be created by forming an aperture in the intermediate slide member 26. A protrusion or other mating surface could be raised from the intermediate slide member 26, or a rigid element could be attached to the intermediate slide member 26. The edge 75 and latch arm 51 are positioned on the intermediate slide member 26 with surface 67 of spring arm 63 in contact with the edge 75. The edge 75 does not lie within the plane of vertical body 55, which is the reason for the bends 64, 66 in spring arm 63. In an alternative embodiment the edge 75 projects a sufficient distance into the plane of vertical body 55 so that offset of spring arm 63 is not necessary.

Pivoting, or rotating, latch arm 51 in what is viewed in FIG. 2 as a counterclockwise direction results in the compression of spring arm 63. The compression of spring arm 63 occurs because pivoting latch arm 51 causes the forward surface of spring arm 63 to bear against edge 75 and thereby undergo linear movement, whereas in the absence of edge 75 cylindrical section 65 would trace a circular arc with a radius that extends beyond edge 75. With the above in mind, spring arm 63 and the edge 75 may have a variety of shapes and forms so long as pivoting of the latch arm results in compression of spring arm 63. Similarly, instead of using compression of a spring arm to maintain the latch arm in the biased, or engageable position, it is also possible to use tension of a spring arm or other spring means acting in an opposing direction to maintain the latch arm in the biased position. Furthermore, translation of a latch arm may be used instead to the same effect as pivoting in generating compressive or tensive forces in a spring arm.

A boss 77 (shown in FIG. 5) is placed on the lower part of the C-section of the inner slide member 41, to act as a locking element for V-shaped section 61 of the latch arm 51. The boss 77 must be of sufficient dimension to contact V-shaped projection 61 of latch arm 51 when latch arm 51 is in a biased position, which will be later described. Because the purpose of the boss 77 is to contact V-shaped projection 61 of latch arm 51, structures other than the boss 77 may be used. For example, a block of rigid or semi-rigid material could instead be attached to the inner slide member 41.

A cut-out 71 is formed in the web 27 of the intermediate slide member 26. The cut-out 71 is positioned so that the projection 59 of latch arm 51 extends through the cut-out 71. An aperture or slot may be used in place of cut-out 71. Cut-out 71 is of a dimension such that the projection 59 of latch arm 51 contacts an edge of the cut-out 71 when pivoting in the forward or counterclockwise direction prior to spring arm 63 reaching maximum compression. If spring arm 63 is allowed to travel beyond this point overrotation occurs as the compressive force on spring arm 63 forces spring arm 63 away from the engageable position and the latching mechanism becomes inoperable.

An actuating ramp 91 extends from web 17 of the outer slide member 11. The ramp 91 has an inclined upper surface 93 which is engageable with the underside of projection 59 of latch arm 51. Extension of the intermediate slide member 26 relative to the outer slide member 11 causes projection 59 of latch arm 51 to contact ramp 91. This contact overcomes the oppositely directed compressive force generated by spring arm 63 and causes protrusion 61 of latch arm 51 to generally move in the heretofore described vertical direction. This in turn causes latch arm 51 to pivot in the counter-clockwise direction, thereby raising V-shaped projection 61. As the intermediate slide member 26 extends relative to the outer slide member 11 past this point of contact, the projection 59 from latch arm 51 comes to rest on a horizontal upper surface 95 of the ramp 91 located immediately forward of the inclined surface 93.

Figure 5:
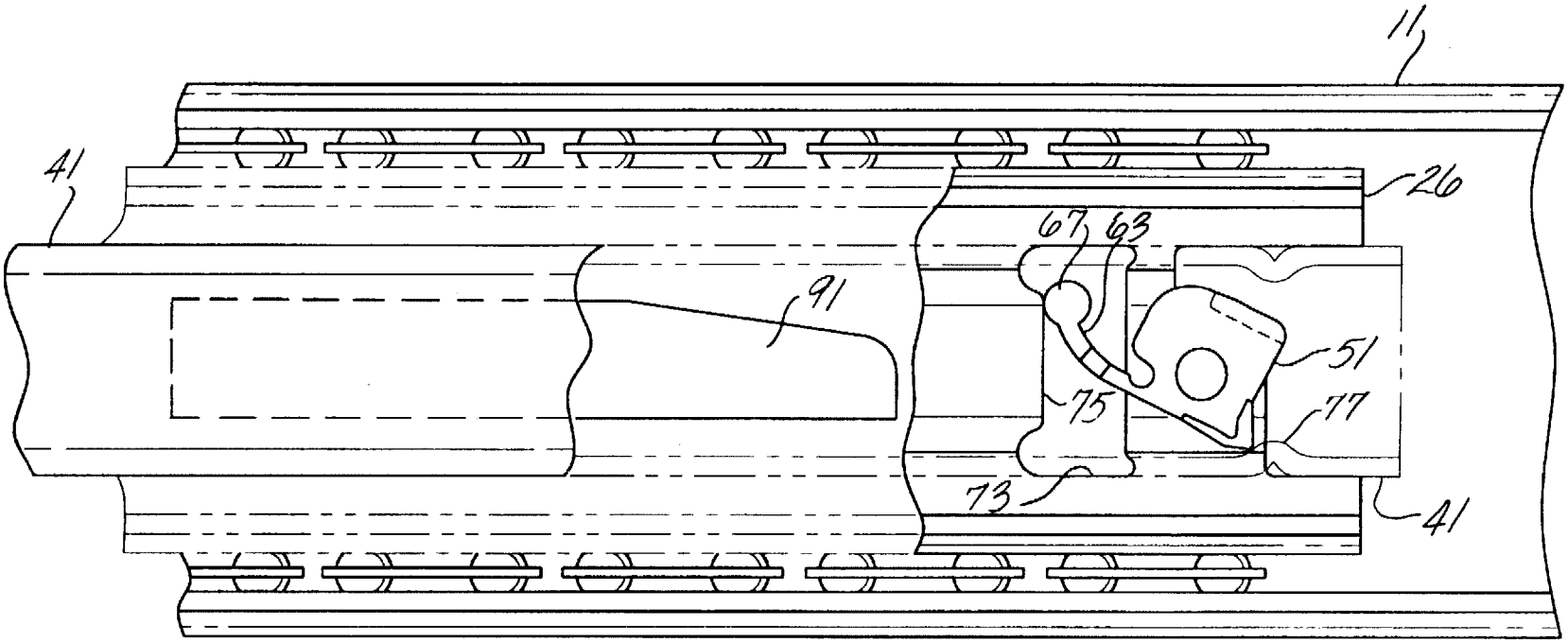
FIG. 5 is an in-board side view of the slide of FIG. 1 with the latch arm in the engaged position with portions of the webs of the inner and intermediate slide members cut away.
Figure 6:
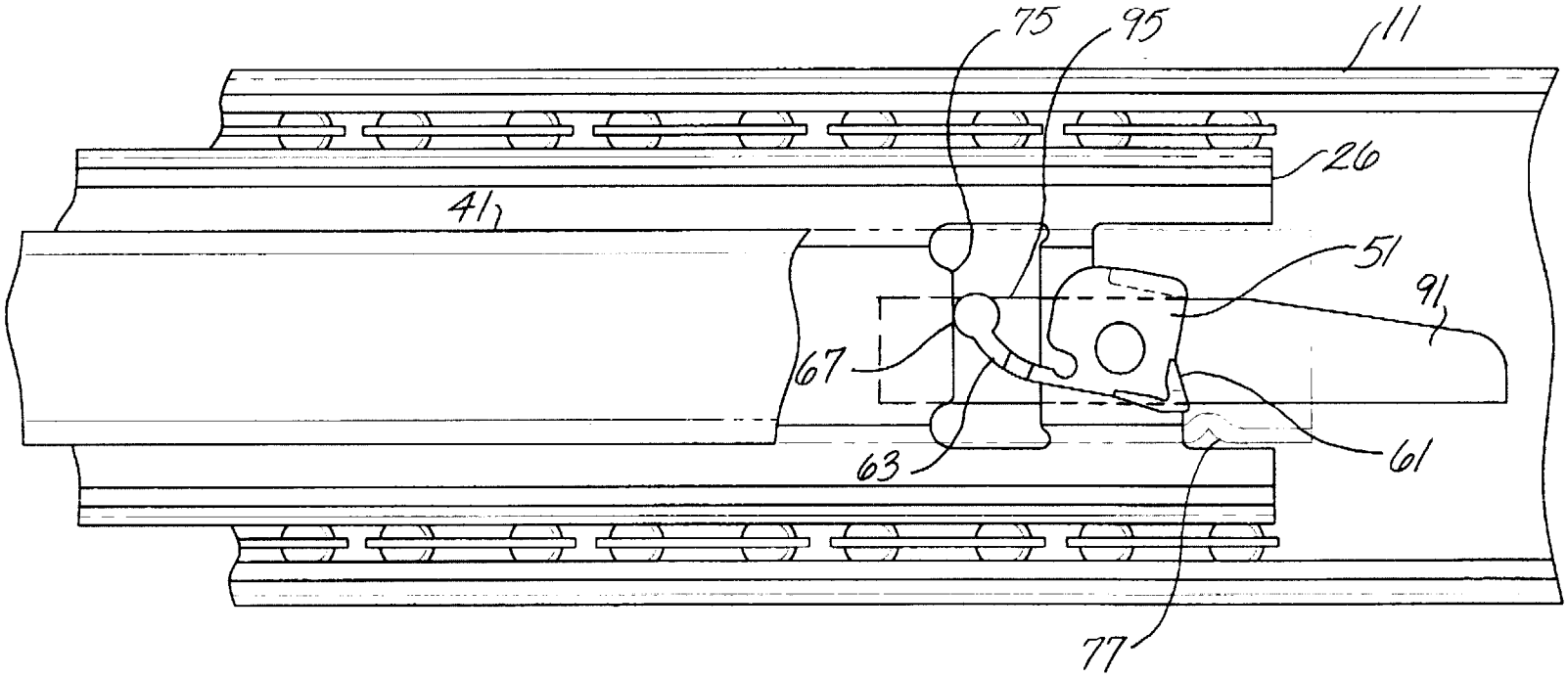
FIG. 6 is an in-board side view of the slide of FIG. 1 with the latch arm in the disengaged position with a portion of the inner slide member cut away.

The operation of the sequencing latch can be further understood with reference to FIGS. 5 and 6. FIG. 5 shows the slide in the partially extended position. The inner slide member 41 and the intermediate slide member 26 are extended a small distance from the outer slide member 11. The inner slide member 41 is restricted from traveling, or movement, with respect to the intermediate slide member 26 due to the engagement of latch arm 51 by the boss 77, which acts as a locking element. Specifically, V-shaped projection 61 of latch arm 51 obstructs the pathway of the boss 77 due to the biased position of latch arm 51. Latch arm 51 is maintained in the biased position by the contact between the forward contour 67 of spring arm 63 and the edge 75 of aperture 73 in intermediate slide member 26. Furthermore, the boss 77 cannot cause latch arm 51 to pivot out of the engaged position due to the boss 77 bearing against the stop face **61*a* of V-shaped projection 61**.

V-shaped projection 61 can be positioned such that the boss 77 bears against face **61*b* of V-shaped projection 61 when latch arm 51 is in the engaged position. With such a V-shaped projection spring arm 63 will normally maintain latch arm 51 in the engaged or biased position. If, however, the intermediate slide member 26 is unable to extend sufficiently for projection 59 to reach the ramp 91 of the outer slide member 11, possibly due to ball bearing migration, forcibly deploying the inner slide member 41 from the intermediate slide member 26 causes the boss 77 to exert additional force against the intermediate face 61*b*, thereby causing latch arm 51** to pivot and allowing for latch operation.

Latch arm 51 undergoes counterclockwise pivoting when the intermediate slide member 26 is moved such that projection 59 of latch arm 51 contacts the actuating ramp 91 of the outer slide member. The actuating ramp 91 obstructs the pathway of projection 59 as the intermediate slide member 26 is extended. Contact between projection 59 and the actuating ramp 91 creates a tensile force with a component oppositely directed and greater than the compressive force generated by the contact between spring arm 63 and the edge 75. Thus, the contact between projection 59 and the actuating ramp 91 causes latch arm 51 to pivot out of the biased, or engaged, position. Additionally, the contact between projection 59 and the actuating ramp 91 may be used to create a frictional interface whereby additional force is required to extend the intermediate slide member 26 sufficiently to cause latch arm 51 to pivot and release the inner slide member 41 for further extension. The amount of force required to overcome the frictional interface depends on the strength and compression of spring arm 63.

The results of the pivoting can be seen in FIG. 6. In FIG. 6, the intermediate slide member 26 has reached a position relative to the outer slide member 11 where projection 59 rests on top of the actuating ramp 91. Spring arm 63 is in compressive contact with the edge 75 of aperture 73 of the intermediate slide member 26. Additionally, V-shaped projection 61 of latch arm 51 has been pivoted to a position where it no longer is engageable with the boss 77 of the inner slide member 41. Thus, the motion of the inner slide member 41 is no longer restricted relative to the intermediate slide member 26.

As shown in FIG. 6, the boss 77 does not contact V-shaped projection 61 when latch arm 51 is not in the biased position. This is not, however, a requirement. The latch arm may be vertically positioned so that contact between the boss 77 and latch arm 51 occurs when latch arm 51 is in the unengaged position, the point of contact being on the transition face 61*c* of V-shaped projection 61. The contact on the transition face induces a force on latch arm 51 pivoting latch arm 51 further from the engaged position, thus allowing the boss 77 to clear latch arm 51. In such a situation the contact between the boss 77 and V-shaped section 61 creates a frictional interface in the retraction of the slide. Similar use may be made of the intermediate face 61*b* to create a frictional interface in the extension of the slide. Furthermore, through the use of various shapes for V-shaped projection 61 and the boss 77 differing components of forces inducing latch arm 51 to pivot can be created, thus allowing for differing amounts of force required to overcome the frictional interface in the extension or retraction of the slide.

Figure 7:
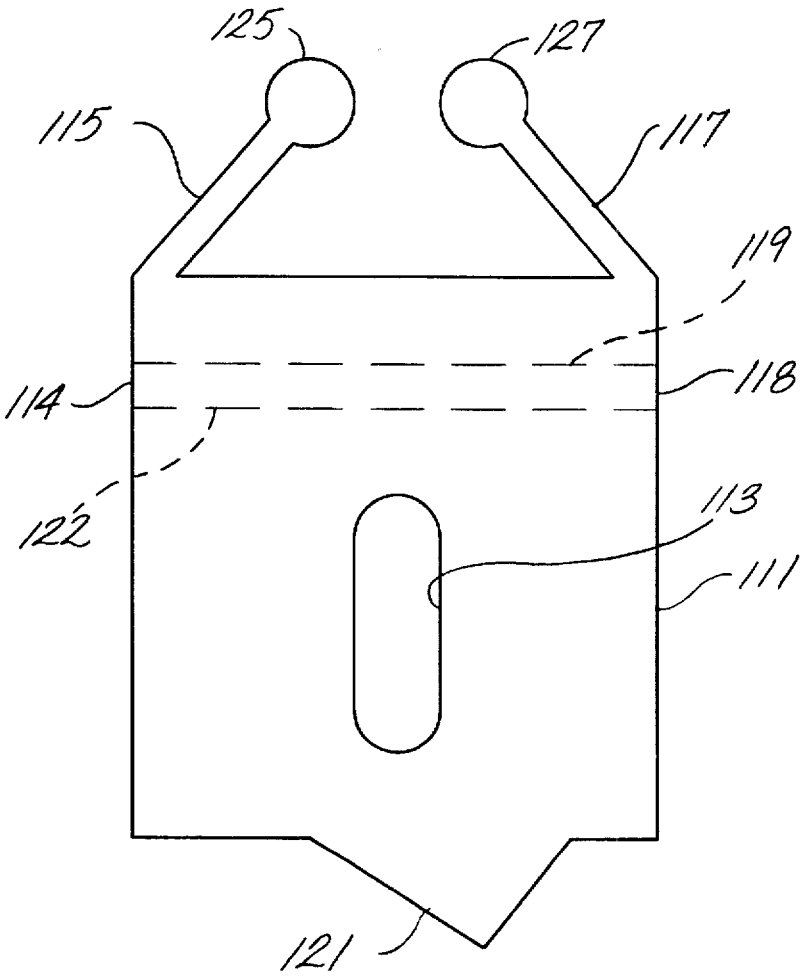
FIG. 7 is a side elevation view of a first alternative embodiment of the latch arm of the present invention.

An alternative embodiment of a latch arm is shown in FIG. 7. As shown therein, latch arm 110 has a substantially flat vertical body 111. A slot 113 extends perpendicularly through vertical body 111 for receiving a rivet or other mechanism for translatably mounting the latch arm to the intermediate slide member. Multiple spring arms 115, 117 extend in what is viewed as the upward direction from and coplanar with vertical body 111. At the end of the spring arms 115, 117 are cylindrical sections 125, 127. A projection 119 (shown in phantom) connects to vertical body 111 and projects at right angle to, or transverse to, vertical body 111. Projection 119 has an upper surface oriented substantially horizontally, side surfaces 114, 118 extending vertically from the upper surface, and a bottom surface 122 connected to the side surfaces. Protruding from the bottom of vertical body 111 is a generally V-shaped projection 121, the point of the V being offset in the rearward direction.

The operation of this embodiment of the latch arm in a slide assembly utilizes similar principles to these utilized in the previously described embodiment. Compression of the spring arms 115, 117 biases latch arm 110 into a position such that V-shaped projection 121 is engageable with the boss 77 (shown in FIG. 5). This compression is caused by contact of cylindrical sections 125, 127 with an edge, protrusion or other non-conformity of the intermediate slide member. The interaction of projection 119 with the activating ramp 91 (shown in FIG. 2) on the outer slide member is substantially as heretofore described, with the exception that the contact between projection 119 and the activating ramp 91 no longer causes the latch arm to pivot, but instead to translate vertically. This vertical translation causes V-shaped projection 121 to be lifted out of the pathway of the boss 77.

Figure 8:
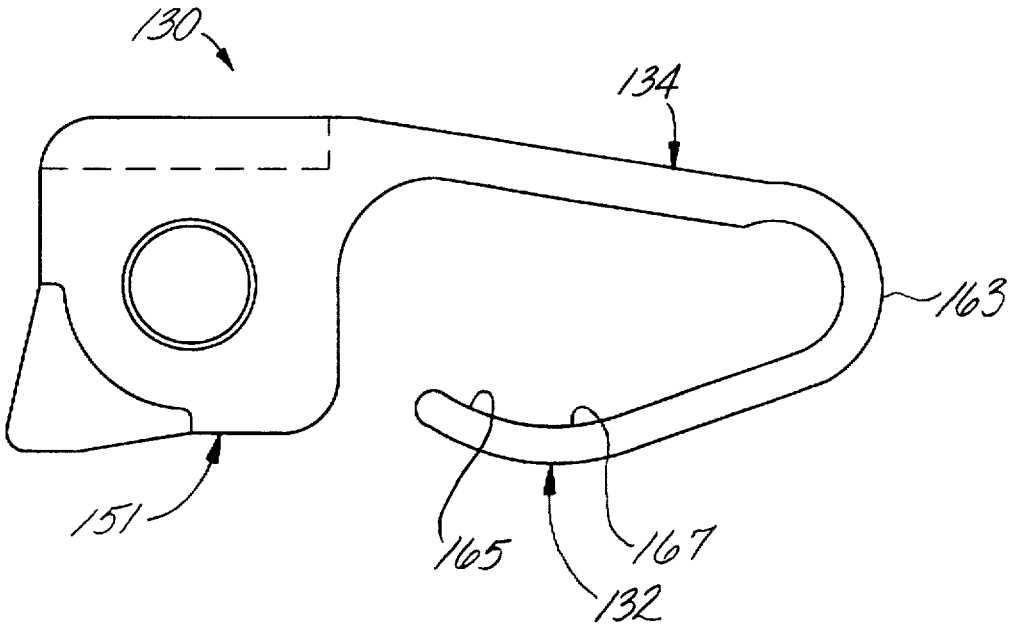
FIG. 8 is a side elevation view of a second alternative embodiment of the latch arm of the present invention.

An additional alternative embodiment of a latch arm is shown in FIG. 8. This latch arm shares similar aspects with the previously described latch arm of FIG. 3, but differs in spring operation. Latch arm 130 has a vertical body 151 with a spring arm 163 extending from what is viewed as the upper and forward section of the vertical body. Spring arm 163 is generally V-shaped and coplanar with vertical body 151, with an attached end 134 extending from vertical body 151 and a free end 132 returning towards vertical body 151 from the distal portion of the attached end 134. Spring arm 163 has an inner surface 164. The inner surface 164 comprises a first area 165 and a second area 167 of spring arm 163 which are adapted to contact a tab (not shown) extending from the intermediate slide member 26. When the latch arm 130 is in the biased position the tab is in contact with the first area 165. Pivoting the latch arm out of the biased position causes the second area 167 to be in contact with the tab, thereby inducing a tensile force causing spring arm 163 to open by biasing free end 132 of arm 163 away from attached end 134 of arm 163. This tensile force therefore tends to cause latch arm 130 to remain in a position engageable with a locking element such as the boss 77 of FIG. 2.

Although this invention has been described in certain specific embodiments, many additional modifications and variations will be apparent to those skilled in the art. It is therefore to be understood that this invention may be practiced otherwise than is specifically described. For example, the locking element may be a protrusion extending from the vertical web of the inner slide member instead of a boss located on the lower edge of the generally C-shaped section of the inner slide member. Additionally, the spring arm or portion of the latch arm need not be part of a unitary latch arm, it may be any spring mechanism causing the latch arm to bias into the engaged position. Thus, the present embodiments of the invention should be considered in all respects as illustrative and not restrictive, the scope of the invention to be indicated by the appended claims rather than the foregoing description.

What is claimed is:

1. A slide mechanism comprising:

an inner slide member;

an intermediate slide member slidably connected to the inner slide member;

an outer slide member slidably connected to the intermediate slide member;

a latch arm carried by the intermediate slide member;

a locking element on the inner slide member for engaging the latch arm when the inner slide member and the intermediate slide member are in a first predetermined position relative to one another;

the latch arm having a spring portion in compressive contact with an edge surface formed on the intermediate slide member, thereby biasing the latch arm into an engageable position; and an actuating element on the outer slide member for biasing the latch arm out of the engageable position when the outer slide member and the intermediate slide member are in a second predetermined position relative to one another.

2. The slide mechanism of claim 1 wherein the latch arm further comprises:

a substantially flat vertical body; and a projection extending transverse to the body engageable with the actuating element.

3. The slide mechanism of claim 2 wherein the projection extends through an aperture in the intermediate slide member and the actuating element comprises a ramp engageable with the projection.

4. The slide mechanism of claim 2 wherein the latch arm has a generally V-shaped projection extending downwardly and outwardly from the body and the locking element is a boss on the inner slide member engageable with the generally V-shaped projection.

5. The slide mechanism of claim 2 wherein the spring portion is an arm extending from the vertical body to the edge surface formed on the web of the intermediate slide member.

6. A slide mechanism comprising:

an inner slide member;

an intermediate slide member slidably connected to the inner slide member;

an outer slide member slidably connected to the intermediate slide member;

a latch arm carried by the intermediate slide member;

a locking element on the inner slide member for engaging the latch arm when the inner slide member and the intermediate slide member are in a first predefined position relative to one another;

spring means in engagement with a portion of the intermediate slide member for normally biasing the latch arm into the engageable position;

an actuating element on the outer slide member for overcoming the spring means and biasing the latch arm out of the engageable position when the outer slide member and the intermediate slide member are in a second predetermined position relative to one another.

7. The slide mechanism of claim 6 wherein the latch arm comprises:

a substantially flat vertical body; and a projection extending transverse to the body engageable with the actuating element.

8. The slide mechanism of claim 7 wherein the projection extends through an aperture in the intermediate slide member and the actuating element comprises a ramp engageable with the projection.

9. The slide mechanism of claim 7 wherein the latch arm has a generally V-shaped projection extending downwardly and outwardly from the body and the locking element is a boss on the inner slide member engageable with the generally V-shaped projection.

10. The slide mechanism of claim 9 wherein the V-shaped projection extends from the body at an angle such that the boss biases the latch arm out of the engageable position when the inner slide member deploys from the intermediate slide member.

11. The slide mechanism of claim 7 wherein the spring means comprises a curved arm portion extending from the body on the side opposite the V-shaped projection and bearing against an edge surface formed on the intermediate slide member.

12. A slide mechanism comprising:

an outer slide member having a substantially vertical web and a pair of upper and lower bearing raceways facing vertically inward;

an intermediate slide member having a substantially vertical web and a pair of upper and lower bearing raceways facing vertically outward;

a first plurality of upper and lower bearings in rolling engagement with respective upper and lower raceways of the outer and intermediate slide members;

an inner slide member of a generally C-shaped section having a pair of upper and lower raceways facing vertically outward;

a second plurality of upper and lower bearings in rolling engagement with the pair of upper and lower raceways of the inner slide member and a second pair of opposed vertically inward facing upper and lower raceways of the intermediate slide member;

a latch arm carried by the intermediate slide member, the latch arm being engageable with a locking element on the inner slide member for restricting relative movement of the inner and intermediate slide members and being engageable with an actuating element on the outer slide member for disengaging the latch arm from the locking element;

the latch arm comprising:

a unitarily formed combination of a substantially flat vertical body having a transverse pivot hole for pivotally mounting the latch to the intermediate slide member;

a spring arm extending from the body, the spring arm in engagement with an edge formed on the substantially vertical web of the intermediate slide member; and a projection extending transverse to the body for engaging the actuating element.

13. The slide mechanism of claim 12 wherein the projection extends through an aperture in the intermediate slide member and the actuating element comprises a ramp engageable with the projection.

14. The slide mechanism of claim 12 wherein the latch arm has a generally V-shaped projection extending downwardly and outwardly from the body and the locking element is a boss on the inner slide member engageable with the generally V-shaped projection.

15. The slide mechanism of claim 14 wherein the V-shaped projection extends from the latch arm at an angle such that the boss biases the latch arm out of the engageable position when the inner slide member deploys from the intermediate slide member.

16. A latch arm for a drawer slide comprising a unitarily formed combination of:

a substantially flat vertical body having a transverse aperture for pivotally mounting the latch arm to a drawer slide;

a generally V-shaped projection extending from the body in a first direction for engaging a locking element of the drawer slide; and a spring arm extending from the body in a second direction for biasing the latch arm into engagement with the locking element.

17. The latch arm of claim 16 further comprising a projection extending transverse to the body for engaging an actuating element of the drawing slide to pivot the latch arm out of engagement with the locking element.

18. The latch arm of claim 16 wherein the generally V-shaped projection extends downward and outward from the vertical body.

19. The latch arm of claim 16 wherein the spring arm extends forward and upward from the vertical body.

20. The latch arm of claim 16 wherein the spring arm is substantially V-shaped and extends forward and downward from the vertical body.

* * * * *